US008505242B1

(12) United States Patent
Kunz

(10) Patent No.: US 8,505,242 B1
(45) **Date of Patent: *Aug. 13, 2013**

(54) COUNTER BALANCE SYSTEM FOR A WINDOW HAVING SIDE LOADING SASHES

(76) Inventor: John R. Kunz, Douglassville, PA (US)

( * ) Notice: Subject to any disclaimer, the term of this patent is extended or adjusted under 35 U.S.C. 154(b) by 523 days.

This patent is subject to a terminal disclaimer.

(21) Appl. No.: 12/764,907

(22) Filed: Apr. 21, 2010

Related U.S. Application Data

(63) Continuation-in-part of application No. 11/827,968, filed on Jul. 16, 2007, now Pat. No. 7,980,028.

(51) Int. Cl.
*E05F 1/00* (2006.01)

(52) U.S. Cl.
USPC ..... 49/447; 16/197

(58) Field of Classification Search
USPC ..... 49/445, 446, 447, 448, 453, 454; 16/193, 197, 401
See application file for complete search history.

(56) References Cited

U.S. PATENT DOCUMENTS

| | | | | | |
|---|---|---|---|---|---|
| 2,262,990 | A | * | 11/1941 | Cross et al. | 16/197 |
| 2,609,193 | A | * | 9/1952 | Foster | 267/156 |
| 2,635,282 | A | * | 4/1953 | Trammell, Sr. et al. | 16/197 |
| 2,644,193 | A | * | 7/1953 | Anderberg | 16/197 |
| 2,732,594 | A | | 1/1956 | Adams | |
| 2,817,872 | A | * | 12/1957 | Foster | 16/197 |
| 3,086,259 | A | * | 4/1963 | Klein | 49/415 |
| 3,160,914 | A | | 12/1964 | Brienza | |
| 3,452,480 | A | * | 7/1969 | Foster | 49/445 |
| 3,992,751 | A | * | 11/1976 | Foster et al. | 16/197 |
| 4,089,085 | A | | 5/1978 | Fitzgibbon | |
| 4,697,304 | A | | 10/1987 | Overgard | |
| 4,935,987 | A | * | 6/1990 | Sterner, Jr. | 16/198 |
| 5,157,808 | A | * | 10/1992 | Sterner, Jr. | 16/197 |
| 5,231,795 | A | * | 8/1993 | Westfall | 49/446 |
| 5,353,548 | A | * | 10/1994 | Westfall | 49/446 |
| 5,463,793 | A | * | 11/1995 | Westfall | 16/197 |
| 5,661,927 | A | * | 9/1997 | Polowinczak et al. | 49/447 |
| 6,393,661 | B1 | * | 5/2002 | Braid et al. | 16/197 |
| 6,745,433 | B2 | | 6/2004 | Newman et al. | |
| 6,802,105 | B2 | * | 10/2004 | Polowinczak et al. | 16/198 |
| 6,860,066 | B2 | * | 3/2005 | Kunz et al. | 49/181 |
| 7,047,693 | B2 | * | 5/2006 | Lundahl | 49/447 |
| 7,506,475 | B2 | * | 3/2009 | Lundahl | 49/506 |
| 7,587,787 | B2 | * | 9/2009 | Pettit | 16/197 |
| 7,980,028 | B1 | * | 7/2011 | Kunz | 49/447 |
| 8,136,301 | B2 | * | 3/2012 | Lundahl | 49/447 |
| 8,181,396 | B1 | * | 5/2012 | Kunz | 49/447 |
| 2004/0006845 | A1 | * | 1/2004 | Polowinczak et al. | 16/197 |

* cited by examiner

*Primary Examiner* — Jerry Redman
(74) *Attorney, Agent, or Firm* — LaMorte & Associates, P.C.

(57) ABSTRACT

A counterbalance system for a side load window assembly having a window sash and side frame jambs. A spring carriage is provided. The spring carriage has a first section that fits into a gap space between the window frame and the window sash. The spring carriage also includes a second section that passes under the window sash. A locking mechanism is disposed in the second section that selectively engages the side jambs and locks the spring carriage in place. At least one coil spring is provided. Each coil spring has a wound body that is held within the spring carriage. Each coil spring also has a first end that extends out of the spring carriage is anchored to one of the side frame jambs. The coil springs bias the spring housing upwardly. Since the window sash rests upon the housing, the window sash is counterbalanced.

11 Claims, 5 Drawing Sheets

COUNTER BALANCE SYSTEM FOR A WINDOW HAVING SIDE LOADING SASHES

RELATED APPLICATIONS

This application is a continuation-in-part of U.S. application Ser. No. 11/827,968, entitled Coil Spring Counter Balance System For Side Loading Window Sashes, filed Jul. 16, 2007 now U.S. Pat. No. 7,980,028.

BACKGROUND OF THE INVENTION

1. Field of the Invention

In general, the present invention relates to counterbalance systems that are used to hold the sashes of a window open. More particularly, the present invention relates to counterbalance systems that are used in window assemblies having side-loading sashes.

2. Prior Art Description

There are many types of windows used in modern construction. Some windows are designed to open, some are not. Of the windows that are designed to open, some windows have sashes that open vertically and others have sashes that slide open laterally, or rotate outwardly.

Windows that have vertically opening sashes are the most common window used in residential home construction. Vertically opening windows are either single-hung, having one sash that opens, or double-hung, having two sashes that open. In both single-hung and double-hung windows, the same system is used to hold a window sash up once it is open. If no system is used, gravity causes the sash of the window to close as soon as it is opened and released.

In low quality windows, friction between the window sash and the window frame is relied upon to hold a sash open. Such a system is highly unreliable because the friction relied upon varies as parts wear, expand, contract and are painted. It is for this reason that most single and double-hung windows are manufactured with counterbalance systems.

Early window sash counterbalance systems were simply weights that were attached to the sash. The weights were attached to a sash by a rope or chain that passed over a pulley at the top of the window frame. Such old counterbalance systems are exemplified by U.S. Pat. No. 3,160,914 to Brienza, entitled Sash Weight Mounting Means. Such counterbalance systems required window wells in which the weights move. Accordingly, such windows were difficult to insulate. Additionally, the rough opening needed for the window had to be much larger than the window sashes. Finally, window sashes attached to such counterbalance systems could not be tilted for cleaning or otherwise removed from the window frame.

Recognizing the many disadvantages of window well counterbalance systems, windows were manufactured with spring loaded counterbalance systems. Spring loaded counterbalance systems relied upon the pulling strength of a spring, rather than a hanging weight, to counterbalance the weight of a window sash. Accordingly, window wells for weights were no longer required.

Counterbalancing a window sash with a coil spring is a fairly simple matter. One end of the coil spring is attached to the window frame while the body of the coil spring is engaged by the sash. One of the simplest examples of a coil spring counterbalance system is shown in U.S. Pat. No. 2,732,594 to Adams, entitled Double Hung Window Sash. The difficulties with such a system occur when a window manufacturer wants to use coil springs to counterbalance a window sash while simultaneously making a window tiltable or removable for cleaning.

In modern tilt-in windows, the window sash tilts for cleaning but never completely leaves the window frame. Counterbalancing such windows can, therefore, be accomplished by attaching coil springs to the end of the window sash that never leaves the frame.

Counterbalancing a window with a sash that is removable is far more difficult. In a window with a removable sash, the counterbalance system must have the ability to connect and disconnect from the sash. The counterbalance system commonly used for a side loading window with a removable sash is a "block and tackle" counterbalance. A block and tackle counterbalance contains pulleys, string and a spring that maintains tension on the string. The end of the string is typically attached to the window sash with a clip. When a window sash is being removed completely from a window frame, the clip must be manually detached from the sash. Once detached, the sash can be removed while the block and tackle counterbalance system remains behind in the jamb of the window frame. Prior art block and tackle counterbalance systems are exemplified in U.S. Pat. No. 6,745,433 to Newman, entitled Side Load Balance Cord Terminal Clip; U.S. Pat. No. 4,697,304 to Overgard, entitled Friction Controlled Window Balance, and U.S. Pat. No. 4,089,085 to Fitzgibbon, entitled Sash Balance and Components Thereof.

There are many problems associated with prior art block and tackle counterbalance systems. First, a block and tackle counterbalance system must be custom designed to correspond to a particular window sash height and/or weight. Different block and tackle counterbalance assemblies must therefore be manufactured to accommodate sashes of different sizes and different weights. Furthermore, block and tackle counterbalance systems are complex assemblies that contain several moving parts. These parts are difficult to assemble and are subject to failure over time. Consequently, block and tackle counterbalance systems tend to be expensive to manufacture and have limited reliability. Another disadvantage of block and tackle counterweight assemblies is that they are difficult to detach and reattach to a window sash and can easily cause injury to an inexperienced person who attempts the task.

A need therefore exists for a counterbalance system that can be used in a window assembly with a side loading sash, wherein the counterbalance system does not use a complex block and tackle construction, is versatile to many window sizes, is simple to attach and detach, and is both simple and inexpensive to manufacture. This need is met by the present invention as described and claimed below.

SUMMARY OF THE INVENTION

The present invention is a counterbalance system for a side load window assembly. The side load window assembly has a window frame with side jambs. At least one window sash is held in the window frame, wherein the window sash is free to be selectively opened and closed. The window sash has a top, a bottom and two vertical sides. When the sash is installed into the window frame, it assumes an operable position where the vertical sides of the window sash are aligned with the side jambs of the window frame. When the sash is in its operational position, a gap space exists between the vertical sides of the window sash and the side jambs of the window frame. This gap space is utilized by the counterbalance system.

The counterbalance system includes a spring carriage. The spring carriage has a first section that fits into the gap space between the window frame and the window sash. The spring carriage also includes a second section that passes under a portion of the bottom of the window sash, therein supporting the window sash when the window sash is in its operable position.

At least one coil spring is provided. Each coil spring has a wound body that is held within the confines of the spring carriage. Each coil spring also has a first end that extends out of the spring carriage. The first end of each coil spring is anchored to one of the side jambs of the window frame.

The coil springs bias the spring carriage upwardly. Since the window sash rests upon the spring carriage, the window sash is counterbalanced. The window sash only rests upon the spring carriage and can be lifted away from the housing. Consequently, the counterbalance system provides a counterbalancing force for a window sash without inhibiting the window sash from being removed from the window assembly.

Locking mechanisms are used to hold the spring carriages in place as the window sashes are removed. The locking mechanisms are slide lock assemblies that engage locking depressions in the side window jambs. The slice lock assemblies include a locking element that slides into the locking depression and a spacer that wedges the locking element into place.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention counterbalance system can be used to counterbalance the sashes in a double-hung window, the exemplary embodiment selected for illustration shows a single-hung window. The choice of a single-hung window was made simply for ease of illustration purposes and should not be considered a limitation upon the invention as claimed.

Figure 1:
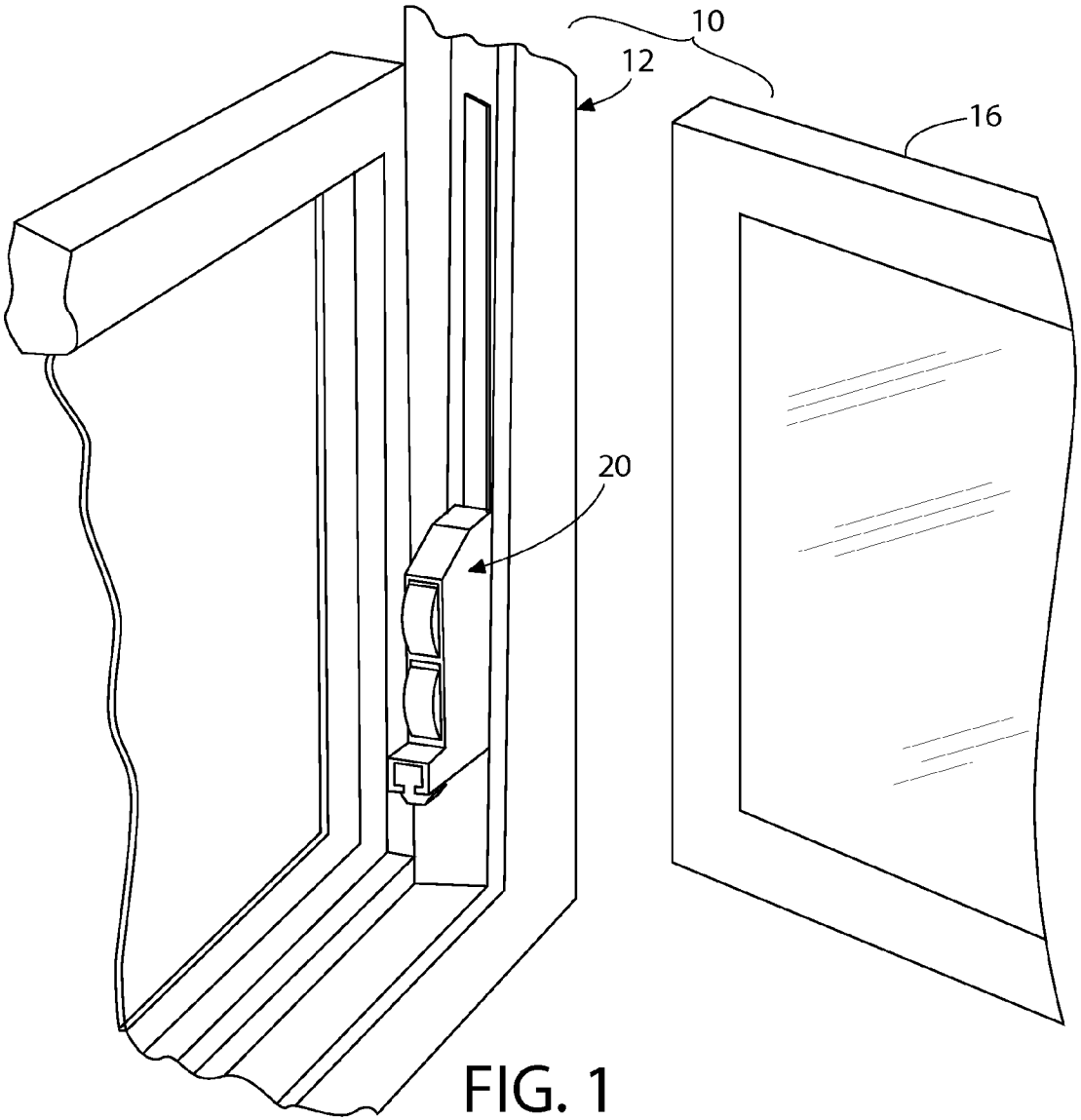
FIG. 1 is a perspective view of an exemplary embodiment of a side load window assembly containing a counterbalance system.
Figure 2:
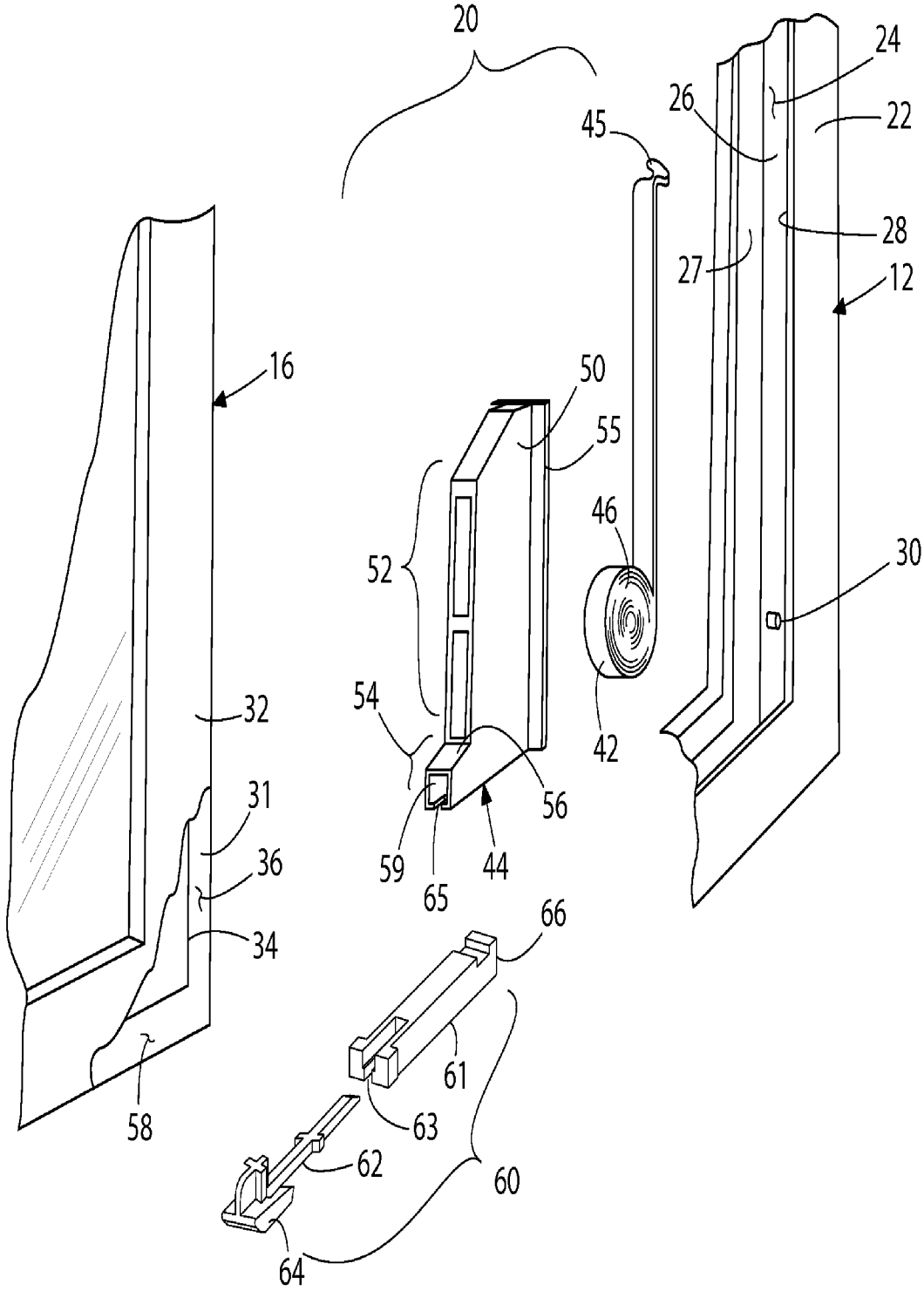
FIG. 2 is an exploded view of the counterbalance system shown utilized in FIG. 1.

Referring to both FIG. 1 and FIG. 2, there is shown a window assembly 10. The window assembly 10 has a window frame 12 that retains both an upper sash (not shown) and a lower sash 16. As has been previously stated, the window assembly 10 is being illustrated as a single-hung window, meaning that only the lower sash 16 can be opened.

The window assembly 10 is constructed to be a "side load" window. A side load window is a common window type where one or more of the sashes can be selectively removed from the window frame. For a variety of reasons, side load windows are commonly used in the construction of many types of replacement windows.

In a side load window, a sash can be completely removed. In the shown exemplary embodiment, the lower sash 16 has side load features and is removable.

Depending upon the size of the window assembly 10, the window sash 16 may have a weight of between five pounds and fifty pounds. Furthermore, the window sash 16 may have a length and height that varies between one foot and three feet.

When the window sash 16 is loaded into the window frame 12, it enters its operable position. In its operable position, the window sash 16 can be selectively opened and closed by being slid up and down. To prevent the window sash 16 from closing under the force of its own weight, it must be counterbalanced. A counterbalance system 20 is provided to retain the window sash 16 in an open position. The counterbalance system 20 is especially designed for side load windows. Furthermore, the counterbalance system 20 is highly versatile, wherein a single counterbalance system can be adapted for use in window assemblies having sashes in a wide variety of sizes and weights.

Figure 3:
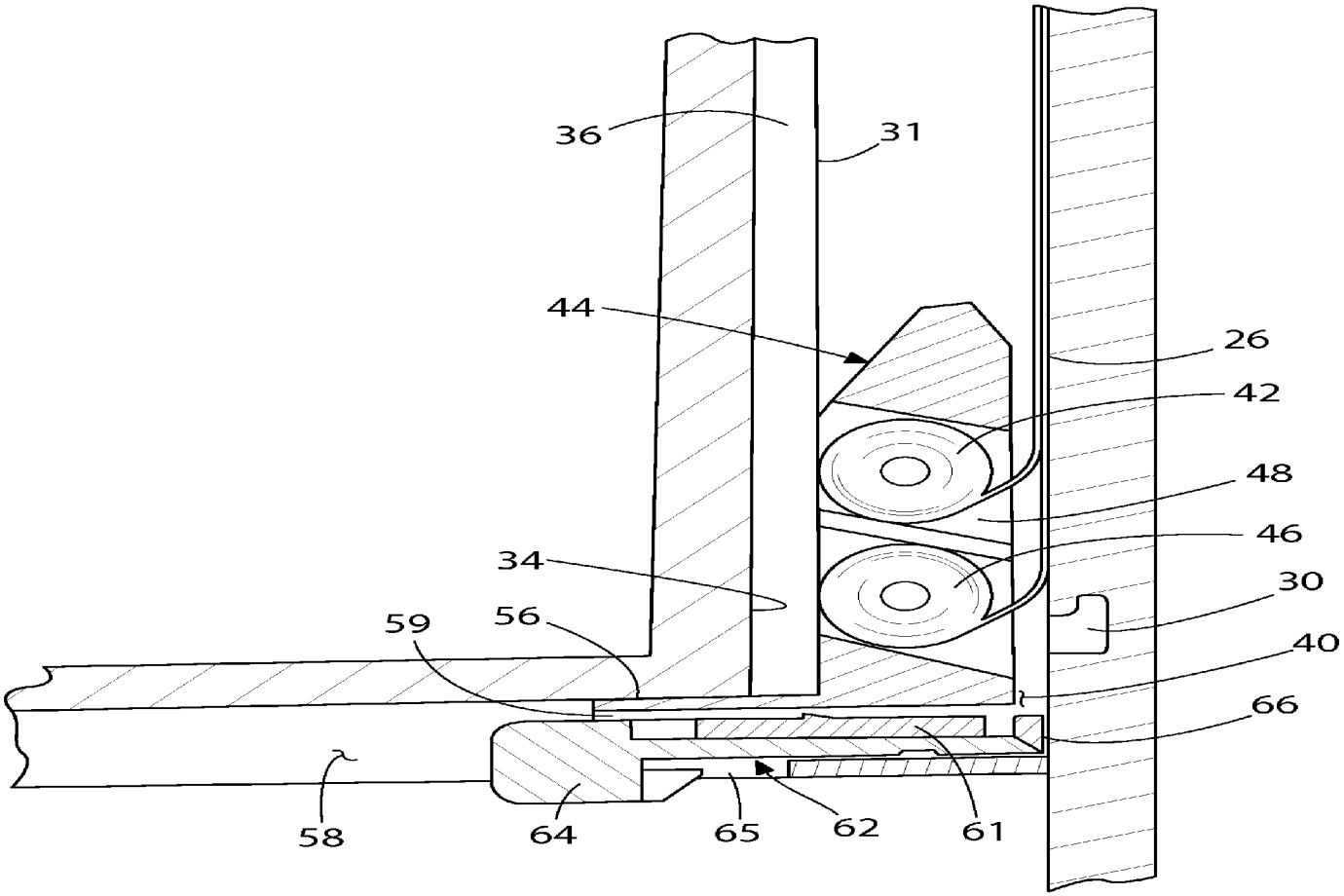
FIG. 3 is a cross-sectional view of the counterbalance system shown unlocked and with the window sash in its operational position.

Referring to FIG. 2 in conjunction with both FIG. 3, it can be seen that the window frame 12 has side jambs 22. Each of the side jambs 22 defines a primary channel 24 in which the window sash 16 rides. Each primary channel 24 is defined by a back surface 26 that lay perpendicular to the plane of the window sash 16 and two side surfaces 27, 28 that lay in planes parallel to the plane of the window sash 16. A locking depression 30 is formed in the back surface 26 of the primary channel 24 at a predetermined position. The purpose of the locking depression 30 is later described.

The window sash 16 has a width that is sized to pass into the primary channel 24 of the side jamb 22. The window sash 16, therefore, rides within the primary channel 24 as it moves up and down. The front and rear surface 31, 32 of the window sash 16 extend beyond the vertical sides 34 of the window sash 16. This creates a secondary channel 36 along the sides 34 of the window sash 16. When the window sash 16 is installed into the window frame 12, the secondary channel 36 along the window sash 16 faces the primary channel 24 along the side jamb 22. This creates a gap space 40 between the window sash 16 and the side jamb 22. The gap space 40 is utilized to hold the counterbalance system 20, as is explained below.

The counterbalance system 20 relies upon coil springs 42 to counteract the weight of the window sash 16. However, the coil springs 42 are not directly attached to the window sash 16. Rather, the counterbalance system 20 utilizes a spring carriage 44 that holds the wound body 46 of the coil spring 42. The spring carriage 44 extends into the gap space 40 between the side jamb 22 and the window sash 16. The spring carriage 44 supports the weight of the window sash 16 and transfers that weight to the coil springs 42.

The spring carriage 44 includes a housing 50. The housing 50 has a top section 52 and a base section 54. The top section 52 is narrow and is sized to fit into the gap space 40 that exists between the side jamb 22 and the window sash 16. To prevent the top section 52 from moving within the gap space 40 and making noise, the top section 52 includes a spacer flange 55. The spacer flange 55 has a width just slightly smaller than the back surface 26 of the primary channel 24. The spacer flange 55 rides between the side surfaces 27, 28 of the primary channel 24 and keeps the housing 50 in its proper orientation.

The base section 54 of the housing 50 is longer than the top section 52 and does not fit into the gap space 40. Rather, the base section 54 has a lateral sill 56 that extends under the window sash 16 so that the window sash 16 rests upon the lateral sill 56, whereby the lateral sill 56 supports the weight of the window sash 16.

A bottom groove 58 is present on the bottom of the window sash 16. The bottom groove 58 receives the lateral sill 56 extending from the spring carriage housing 50. Only gravity holds the window sash 16 in place upon the lateral sill 56 of the spring carriage housing 50. It will therefore be understood that the window sash 16 can be lifted upwardly off the lateral sill 56.

The spring carriage 44 defines at least one spring compartment 48. In the shown embodiment, a plurality of spring compartments 48 are shown. Each of the spring compartments 48 holds the wound body 46 of a coil spring 42. Each coil spring 42 has a free end 45. The free end 45 of each coil spring 42 extends out of the housing 50 and up the back surface 26 of the primary channel 24 in the side jamb 22. The number of coil springs 42 that are used is dependent upon the weight of the window sash 16. For example, if each coil spring 42 provides a counterbalance force of five pounds, and a window sash 16 weighs twenty pounds, then a total of four coil springs 42 would be used, two on each side of the window sash 16.

The free ends 45 of the coil springs 42 are anchored to the back surface 26 of the primary channel 24 at some high point along the side jamb 22. Accordingly, as each coil spring 42 unwinds, the natural curvature associated with the coil spring 42 causes the unwound sections of the coil spring 42 to press against the back surface 26 of the primary channel 24. The unwound sections of the coil springs 42 are therefore kept flush against the back surface 26 of the primary channel 24. The coil springs 42 provide an upward bias to the window sash 16 that counterbalances its weight. Accordingly, the window sash 16 will stay in position once opened.

The base section of 54 of the spring carriage 44 defines a horizontal channel 59. A slide lock assembly 60 is disposed in the horizontal channel 59. The slide lock assembly 60 is a two-part assembly that contains both an elongated lock element 61 and a sliding spacer 62. Both the elongated lock element 61 and the sliding spacer 62 can move back and forth within the horizontal channel 59. When the window sash 16 is installed in the window frame 12, the slide lock assembly 60 does nothing. The slide lock assembly 60 is retracted into the base section 54 of the spring carriage 44 and does not effect the movement of either the window sash 16 or the spring carriage 44.

The elongated lock element 61 and the sliding spacer 62 interconnect to form the slide lock assembly 60. The elongated lock element 61 has a groove 63 on its bottom surface that is sized and shaped to receive the sliding spacer 62. The groove 63 enables the sliding spacer 62 to move within the elongated lock element 61. It will therefore be understood that although the entire slide lock assembly 60 can reciprocally move within the horizontal channel 59, the sliding spacer 62 can also move relative the elongated lock element 61.

The sliding spacer 62 has a knob 64 that extends below the elongated lock element 61. When the slide lock assembly 60 is positioned within the horizontal channel 59, the knob 64 extends out of the horizontal channel 59 through an open slot 65. The knob 64 enables a person to selectively move the slide lock assembly 60 back and forth in the horizontal channel 59 using manual force. When the knob 62 is manually moved in one direction (to the right in the illustration), the distal end 66 of the elongated lock element 61 extends laterally out of the horizontal channel 59.

Figure 4:
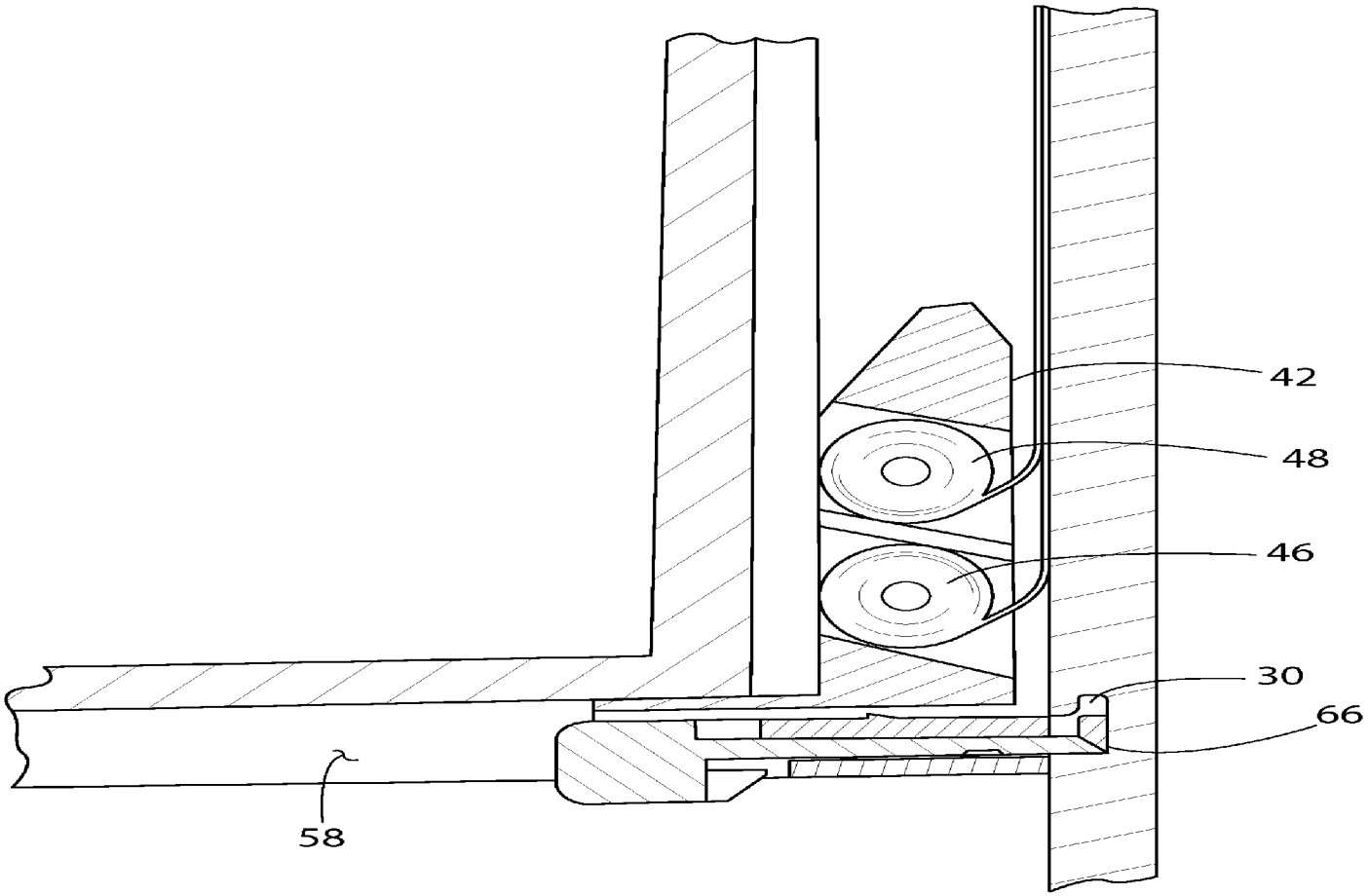
FIG. 4 is a cross-sectional view of the counterbalance system shown partially locked and with the window sash in its operational position.

Referring to FIG. 4 in conjunction with FIG. 3 and FIG. 2, it will be understood that when the window sash 16 is opened to a predetermined height, the slide lock assembly 60 can be made to align with the locking depression 30 in the back surface 26 of the primary channel 24. Once aligned, the distal end 66 of the elongated lock element 61 can be manually moved into the locking depression 30.

When the distal end 66 of the elongated lock element 61 enters the locking depression 30 in the primary channel 24 of the side jamb 22, the spring carriage 44 becomes mechanically interconnected to the side jamb 22. Accordingly, the spring carriage 44 can no longer be moved. The locking depression 30 is larger than the distal end 66 of the elongated lock element 61. This enables the distal end 66 of the elongated lock element 61 to easily pass into the locking depression 30. This is shown in FIG. 4. However, the loose interconnection also has a disadvantage in that the distal end 66 of the elongated lock element 61 can also easily be moved out of the locking depression 30.

Figure 5:
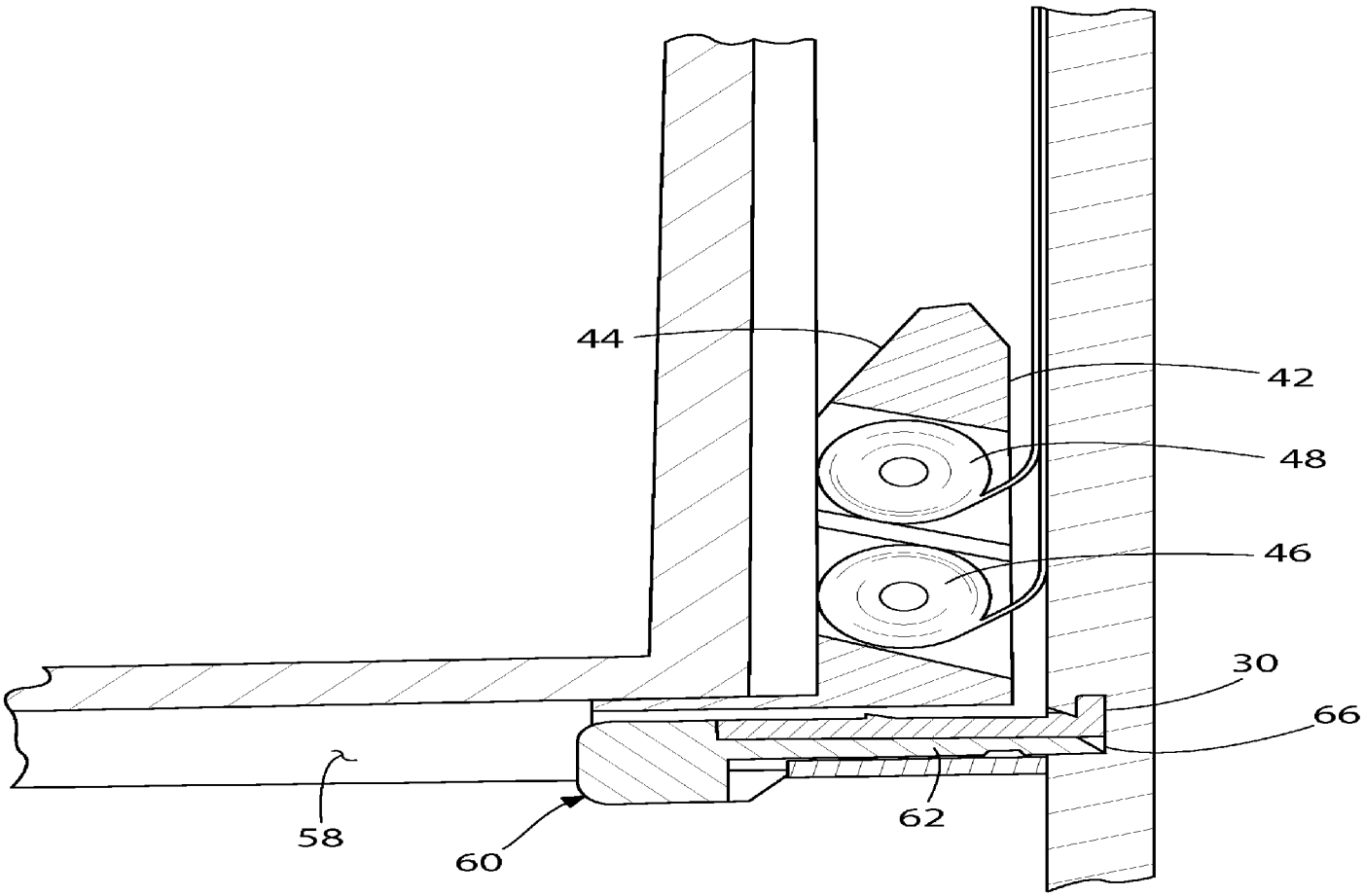
FIG. 5 is a cross-sectional view of the counterbalance system shown in a fully locked condition and with the window sash being removed.

Referring to FIG. 5 in conjunction with FIG. 2, it can be seen that one the distal end 66 of the slide lock assembly 60 is in the locking depression 30, the sliding spacer 62 can also be moved into the locking depression 30. The sliding spacer 62 takes up all the slack between the elongated lock element 61 and the locking depression 30. The addition of the sliding spacer 62 acts as a wedge to lock the elongated lock element 61 into the locking depression 30. This prevents the elongated lock element 61 from inadvertently disengaging from the locking depression 30.

Once the spring carriage 44 is locked in a fixed position, the window sash 16 can be lifted away from the spring carriage 44. Once lifted to a height where the window sash 16 is free of the spring carriage 44, the window sash 16 can be removed from the window assembly.

Each spring carriage 44 used in the present invention counterbalance system 20 can hold between one and four coil springs 42. It will therefore be understood that the counterbalance system 20 can be adapted for use with many different sizes and weights of windows sashes. Heavy window sashes require more coil springs, lighter window sashes require less. Regardless, the spring carriage 44 and the engagement between the window sash 16 and the spring carriage 44 remain the same. A single, low-cost spring carriage 44, in combination with varying numbers of coil springs 42 can therefore be used to counterbalance most any window assembly having jambs and window sashes configured for side loading.

It will be understood that the embodiment of the present invention that is described and illustrated is merely exemplary and that a person skilled in the art can make many variations to the invention using functionally equivalent components. For instance, the slide lock can be reconfigured in many ways. The spring carriage can be configured to hold only one, three, or four coil springs, rather than the two illustrated. All such variations, modifications and alternate embodiments are intended to be included within the scope of the present invention as defined by the claims.

What is claimed is:

1. A side load window assembly, comprising:

a window frame having side jambs, wherein a locking depression is disposed in at least one of said side jambs;

a window sash having a top, a bottom and two vertical sides, said window sash being selectively positionable into an operable position where said vertical sides of said window sash are aligned with said side jambs of said window frame, and wherein a gap space exists between said vertical sides of said window sash and said side jambs of said window frame when said window sash is in said operable position;

a spring carriage having a first section that fits into said gap space between said window frame and said window sash, and a second section that passes under a portion of said bottom of said window sash, therein supporting said window sash when said window sash is in said operable position;

a locking mechanism that selectively extends from said spring carriage and engages said locking depression, therein locking said spring carriage in a fixed position within said window frame;

at least one coil spring, each said coil spring being retained in said spring carriage and having a first end extending from said spring carriage, wherein said first end of each said coil spring is anchored to one of said side jambs of said window frame.

2. The assembly according to claim 1, wherein said window sash is separable from said spring carriage by lifting said window sash up and off said second section of said spring carriage.

3. The assembly according to claim 1, wherein said second section of said spring carriage defines a channel and said locking mechanism is a slide lock assembly that is reciprocally movable within said channel.

4. The assembly according to claim 3, wherein said slide lock assembly includes an elongated lock element and a sliding spacer that is movable relative said elongated lock element.

5. The assembly according to claim 4, wherein said elongated lock element is selectively extendable into said locking depression using manual manipulation and said slide spacer is electively extendable into said locking depression separately from said elongated lock element.

6. The assembly according to claim 1, wherein said spring carriage defines a plurality of internal compartments, wherein each of said internal compartments is sized to retain a coil spring therein.

7. In a window assembly having a window sash positioned between two window frame jambs, wherein said window frame jambs contain at least one locking depression, and wherein a gap space exists between said window sash and said window frame jambs, a counterbalance system for said window sash comprising:

a carriage upon which part of said window sash rests when positioned between said two window frame jambs;

a locking mechanism for selectively connecting said carriage to one of said window frame jambs in a fixed position, wherein said locking mechanism selectively engages said locking depression when said carriage is connected to one of said window frame jambs in said fixed position; and a coil spring having a wound body from which a first end of said coil spring can be drawn, said wound body being carried by said carriage in said gap space between said window sash and said window frame jambs, wherein said first end of said coil spring is anchored to one of said window frame jambs.

8. The system according to claim 7, wherein said locking mechanism includes a slide lock assembly that extends from said carriage and engages said locking depression.

9. The system according to claim 8, wherein said slide lock assembly includes an elongated locking element that can be selectively extended into engagement with said locking depression and a sliding spacer that can be selectively and independently extended into engagement with said locking depression.

10. The system according to claim 7, wherein multiple wound bodies of coil springs are retained by said carriage.

11. The system according to claim 10, wherein said carriage defines a plurality of compartments, wherein each of said compartments retains a wound body of a coil spring.

* * * * *